United States Patent [19]

Fawcett, Jr. et al.

[11] 4,021,796

[45] May 3, 1977

[54] PUSHBUTTON PURMUTATION CODE CONTROL MEANS FOR A SECURITY ALARM SYSTEM

[75] Inventors: James M. Fawcett, Jr., Flossmoor; Ronald G. Stillman, Olympia Fields, both of Ill.

[73] Assignee: Detect-All Security Systems, Inc., Matteson, Ill.

[22] Filed: Oct. 15, 1975

[21] Appl. No.: 622,672

[52] U.S. Cl. ..... 340/274 C; 340/408; 340/409; 340/164 R; 361/172

[51] Int. Cl.[2] ..... G08B 13/08; G08B 29/00

[58] Field of Search ..... 340/274 C, 63, 276, 340/409, 408, 164 B, 164 A, 164 R; 317/134

[56] References Cited

UNITED STATES PATENTS

| | | | |
|---|---|---|---|
| 3,441,808 | 4/1969 | Crane | 340/274 C |
| 3,529,292 | 9/1970 | Neill et al. | 340/408 |
| 3,544,987 | 12/1970 | McMann, Jr. et al. | 340/276 |
| 3,633,167 | 1/1972 | Hedin | 340/164 R |
| 3,648,268 | 3/1972 | Paull | 340/409 |
| 3,659,154 | 4/1972 | Finn | 340/164 R |
| 3,778,770 | 12/1973 | Hagendoorn et al. | 340/164 B |
| 3,833,895 | 9/1974 | Fecteau | 340/408 |
| 3,839,710 | 10/1974 | Rogers | 340/274 C |
| 3,881,171 | 4/1975 | Moorman et al. | 340/274 C |
| 3,953,769 | 4/1976 | Sopko | 317/134 |

*Primary Examiner*—Glen R. Swann III
*Attorney, Agent, or Firm*—Olson, Trexler, Wolters, Bushnell & Fosse, Ltd.

[57] ABSTRACT

An activation and deactivation circuit is provided for a security alarm system and includes selector means for selecting a predetermined coded number for enabling and disabling the alarm system. A coded circuit is responsive to the predetermined code from the selector to produce a control signal for enabling the alarm circuit when disabled and disabling the alarm circuit when enabled. Should an error in the predetermined coded number be detected, it is registered in a memory circuit and a second error will activate the alarm, thereby indicating tampering by unauthorized personnel.

13 Claims, 4 Drawing Figures

10
12
AUDIO ALARM
TO POLICE STATION
SILENT PANIC
13
CONTROL CIRCUIT BOX
11
14
15
16
17
DOORS AND WINDOWS
31
REMOTE ACCESS SELECTOR
30
34
36
37
38
33
20
LOCAL ACCESS SELECTOR
ON
OFF
21
22
23
24
26
27
28

PUSHBUTTON PURMUTATION CODE CONTROL MEANS FOR A SECURITY ALARM SYSTEM

BACKGROUND OF THE INVENTION

This invention relates generally to an alarm system, and more particularly to activation means for enabling and disabling an alarm system.

Prior art enabling circuits for alarm systems have been provided wherein a predetermined coded number, such as a combination, is selected to enable or disable the alarm circuit. It has been found that many persons have developed expertise in criminal or unauthorized entry into premises guarded by security systems including number selection devices such as push buttons, and such persons have circumvented the system by dusting the push button panel and determining which of the buttons is covered with oil as a result of finger manipulation by the user. Having thus discovered which of the push buttons are commonly used, the burglar then repeatedly manipulates the numbers in different sequences until a proper deactivation code is reached.

SUMMARY OF THE INVENTION

Accordingly, it is an object of this invention to provide a new and improved activation means for a security alarm system wherein inadvertent or unauthorized actuation of digits other than the digits associated with the predetermined coded number will cause the alarm to be energized, thereby warding off unauthorized personnel.

Another object of this invention is to provide an improved activation means wherein an additional digit added to the predetermined coded number will actuate a silent panic alarm system to be energized at a remote location, such as a police station, to indicate an unauthorized entry.

Briefly, the alarm system of this invention includes circuit means to enable the alarm to be used for a fire alarm, burglar alarm, emergency alarm, and the like. A control panel includes a solid state control circuit which is formed by a plurality of integrated circuit chips and which control circuit is mounted in a burglar-proof tempered steel control box. A digital logic circuit is utilized to provide a burglar-proof push button activation system which will trigger an alarm and/or a silent communication system by a compatible programmed dialer or digital communication panel connected directly to a police department or other security force. This burglar-proof push button switch arrangement will therefore notify the police department or guard personnel that an unauthorized person is attempting to deactivate the alarm system by improperly actuating the push button actuation-deactuation system.

While push button or other signalling panels having various numbers of switches may be used, the use of a twelve digit push button panel, along with a five digit code number is contemplated. With such a system, over 90,000 separate activation combinations are provided. Therefore, the likelihood of unauthorized personnel actuating the push buttons or signalling switches in the proper sequence within one, two or a few attempts is, for practical purposes, non-existant. Therefore, the system further includes circuit means having a memory which is capable of detecting and storing an error in the signals received from the push button panel. The circuitry also has means for recognizing a subsequent error and then actuating an alarm. Therefore, upon a second improper attempt to deactivate the alarm system, the alarm is activated. The alarm may be a local visual or audible alarm such as a siren and/or a silent alarm to a police department or security guard.

The alarm system of this invention preferably includes a two digit status code selector circuit which enables the user to select the predetermined two digit code to obtain information as to the status i.e. either armed or unarmed, of the alarm system. Also a special emergency panic circuit is provided to enable the user to immediately set off an alarm upon actuation of a single panic button after either actuating the two digit status code or the five digit de-activation code. In installation where a plurality of doors, windows or like areas are to be monitored, the system may include means for indicating a loop status or zone status when the status code is entered.

Many other objects, features and advantages of this invention will be more fully realized and understood from the following detailed description when taken in conjunction with the accompanying drawings wherein like reference numerals throughout the various views of the drawings are intended to indicate similar elements or components.

DETAILED DESCRIPTION OF THE ILLUSTRATED EMBODIMENT

Figure 1:
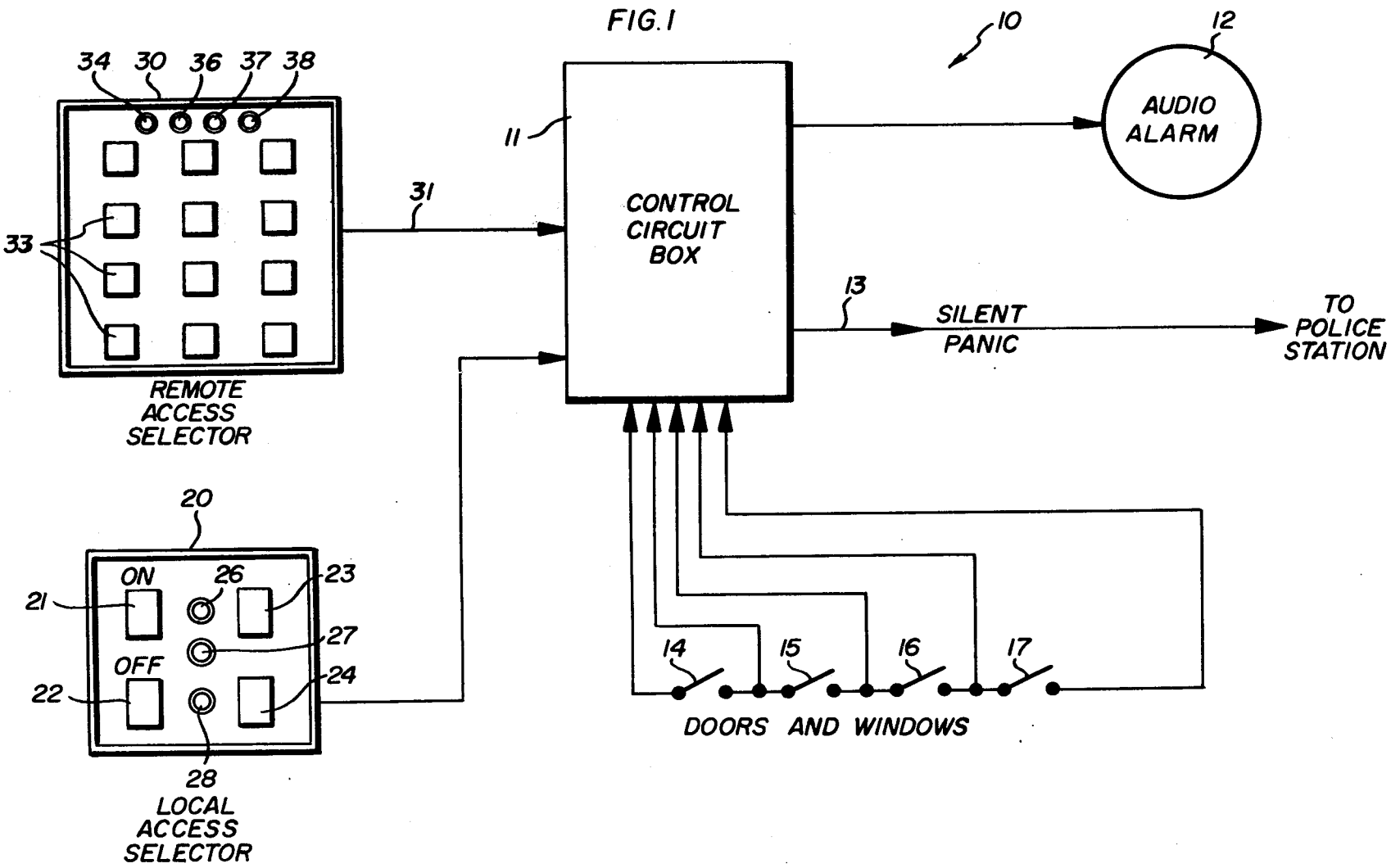
FIG. 1 is an overall simplified block diagram of a security alarm system incorporating the features of this invention.

Referring now to FIG. 1 there is seen a security alarm system constructed in accordance with the principles of this invention and designated generally by reference numeral 10. The security alarm system 10 includes a main control circuit box 11, preferably constructed of heavy gauge tempered steel and which includes a high-security lock or the like. The control box is connected to an audio alarm device 12. The audio alarm device may be a high volume electronic horn operated by a horn driver circuit from the control box. Preferably the horn driver circuit is a two channel driver providing a fast sweep oscillation for indicating such events as fire, and a slow sweep oscillation for indicating such events as burglary or the like. The control box 11 also includes a separate local cutoff switch to provide the user with the capability of cutting off the local noise at any time.

In addition to the local noise alarm, the system has a silent alarm capability for transmitting information to a local police station or the like. The silent alarm may be delivered to the police station over conventional telephone lines indicated by reference numeral 13. The security alarm system 10 has a plurality of switches 14, 15, 16 and 17 which represent switches actuated by opening and closing of doors and windows and the like. These switches are termed in the art as zone protective devices. The switches are connected to the control box 11 wherein they are paralleled with shunting switches to bypass any one or all of the zone switches.

The electronic circuitry within the control circuit box 11 is enabled and disabled by a local access selector panel 20 which includes an ON push button switch 21, an OFF push button switch 22, and a pair of panic alarm switches 23 and 24. The panic alarm switches 23 and 24 can be of the silent panic and local visual or audible panic types respectively. The local access selector panel 20 also includes light indicators 26, 27 and 28 connected by suitable circuitry, not shown, to indicate open circuit, zone off and system on conditions, respectively. The open circuit indication light 26 indicates that one of the zone switches 14, 15, 16 or 17 is open. The zone off indicating light 27 indicates that one of the zones represented by the switches 14, 15, 16 and 17 is bypassed by the selector switch within the control circuit box 11. Therefore, if a complete security alarm system is to be effective, the zone off switch should be disabled so that all of the zone monitoring switches 14, 15, 16 and 17 are effective.

Most advantageously, a remote access selector panel 30 is coupled to the control circuit box 11 over a multiconductor cable indicated by reference numeral 31. The remote access selector panel 30 is located at the exterior of a building or the like at a location displaced from the control circuit box a distance limited only by the length of the conductor cable 31. Preferably, the remote access selector panel includes 12 push buttons indicated generally by reference numeral 33, these push buttons are identified with a standard alphanumeric arrangement, as for example numbered from 1 through 10 and lettered A and B for the 12 buttons.

When the control circuit box is to be armed to place the security alarm system in an ON condition, a predetermined code is selected by manually actuating a plurality of the push buttons 33 in a prescribed sequence. Upon completion of the sequence, an indicating light 34 is energized momentarily for example 5 seconds or so, to indicate that the system is on. After the short indicating period the light 34 is deenergized so that unauthorized personnel have no way of determining whether or not the system is on or off.

In the illustrated embodiment, the access activation and deactivation code is illustrated as being a five digit code selected from a 12 digit panel. This enables the control system to provide over 90,000 different combinations of numbers. When the authorized person wishes to enter the building, the security alarm system is disarmed by again selecting the predetermined coded number from the selector panel. This is done by manually manipulating the push buttons in a predetermined sequence. Upon completion of actuating the push buttons in the proper sequence, an indicating light 36 is energized momentarily to indicate that the system is off.

The remote access selector panel 30 also is used to actuate a status indicating circuit within the control circuit box 11. In the illustrated embodiment, the status selector is a two digit code selected from two of the 12 digits of the panel 30 and will energize a status indicating circuit to operate the indicating lights 34 and 36 to indicate whether the system is ON or OFF. Indicating lights 37 and 38 are also provided on the remote axis panel and may correspond to the indicating lights 26 and 27 of the local access selector to show whether or not the zone detector switches 14, 15, 16 and 17 are open circuits or if one of the zones is bypassed by the bypass circuit within the control box 11.

Figure 2A:
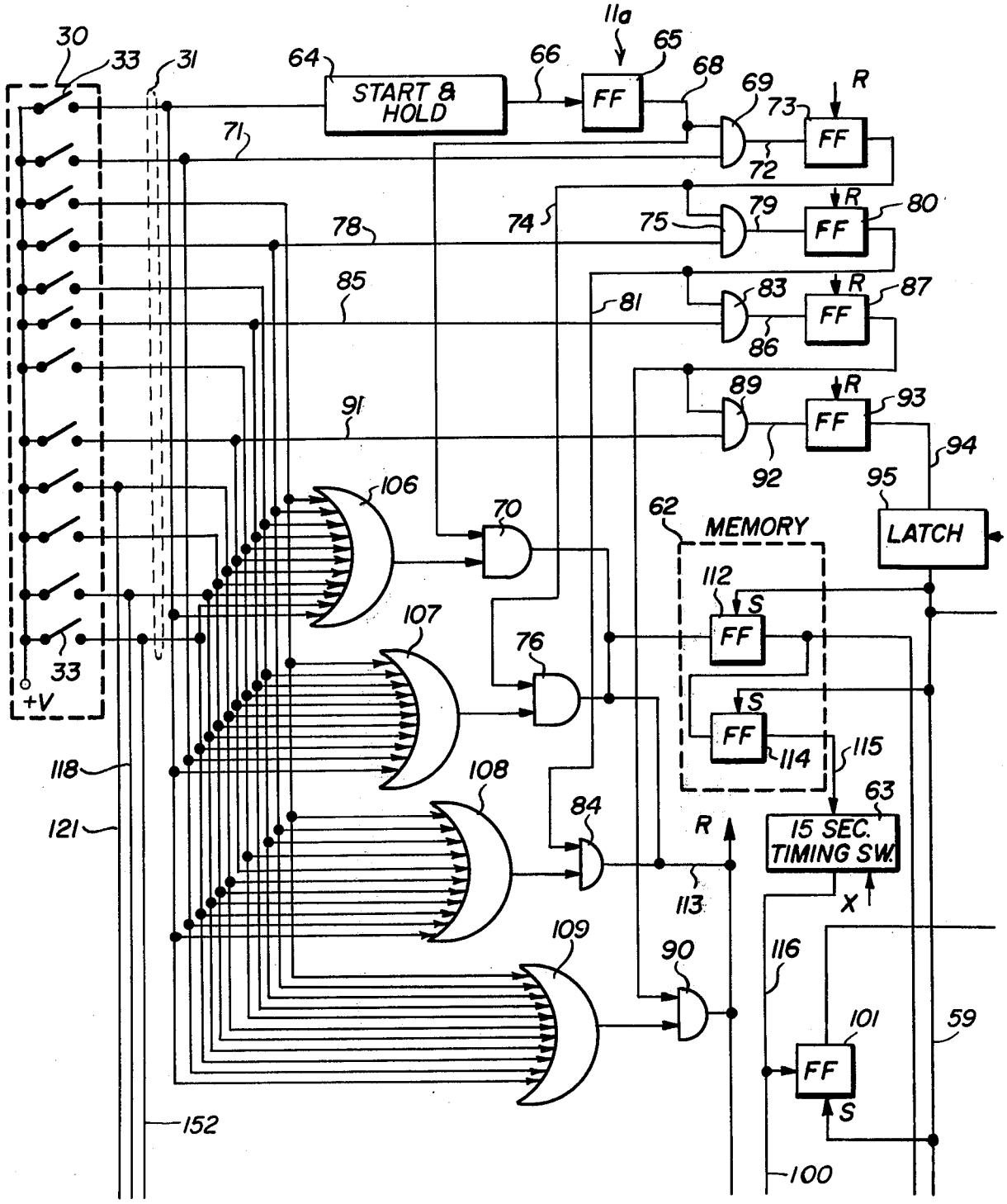
FIGS. 2*a*, 2*b* and 2*c* are the detailed logic circuit diagrams of a security alarm system illustrating this invention.
Figure 2B:
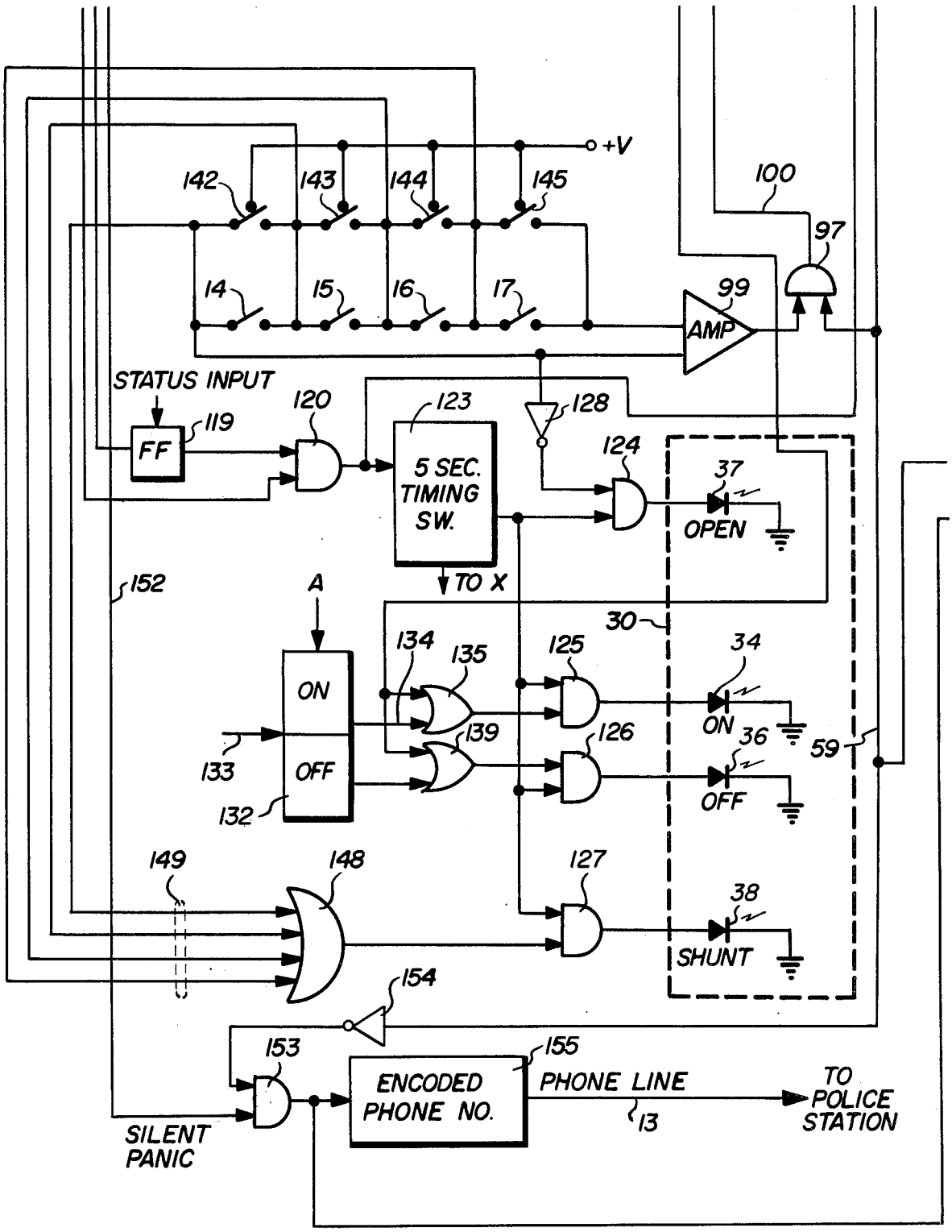
Figure 2C:
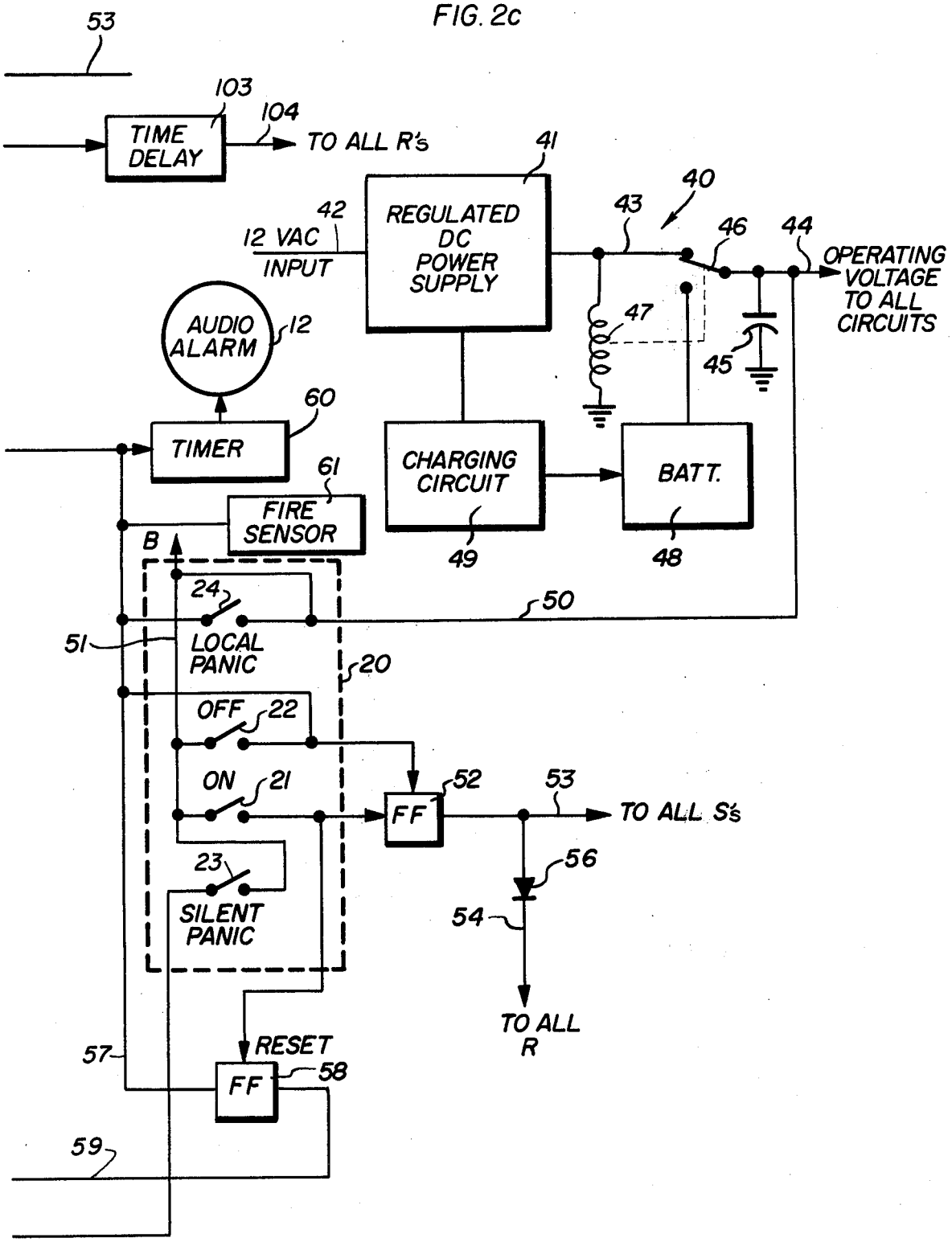

Referring now to FIGS. 2*a*, 2*b* and 2*c*, there is seen a detailed logic circuit diagram of the control circuit contained within the control circuit box 11. The control circuit diagram is designated generally by reference numeral 11*a*. The control circuit includes a power supply designated generally by reference numeral 40 comprising a regulated DC power source 41 obtained from rectification and filtering of a 12 volt AC input signal applied to line 42. The regulated DC power supply has an output line 43 coupled to the output bus terminal designated generally by reference numeral 44 through a relay operated switching element 46. Should a power failure occur and the alternating current voltage be terminated, the switch 46 is actuated by deenergization of the relay holding coil 47 to automatically place stand-by power to the circuit obtained from a battery 48. The battery 48 preferably is of the chargeable type and is continuously trickle charged through a charging circuit 49 when normal operating AC voltage is applied to line 42. However, when a failure occurs and relay holding coil 47 is deenergized, battery 48 will provide sufficient power to operate the security alarm system for 24 hours or more. When power is restored to the input line 42, the charging circuit 49 will again charge the battery 48 to its fully charged condition.

The output terminal bus line 44 from power supply 40 is coupled to the local access control panel 20 through a line 50 and through a jumper line 51 to one side of each of the operating control switches 21, 22, 23 and 24. When the ON switch 21 is momentarily actuated, a flip-flop circuit 52 is automatically placed in a set condition to provide a set output signal on line 53 which is coupled to all of the set controls of the circuit. A reset signal is coupled to all of the reset controls of the circuit through a line 54 and a diode 56. The diode 56 prevents reset signals from being applied to the set signals of line 53.

When switch 22 is momentarily actuated, the flip-flop circuit 52 is reset and the security alarm system 11*a* is disarmed. This is accomplished by providing an output signal from the OFF switch 22 through a line 57 to the input of a flip-flop circuit 58 which disables or disarms the security alarm system. Therefore, when flip-flop circuit 58 is in the set condition, the output thereof applied to line 59 will disable the entire circuit.

The local panic switch 24 receives power from the line 50 and applies it directly to a timer circuit 60 which, in turn, energizes the alarm 12 for a predetermined time interval thereafter. For example, the timer may operate the alarm for a period of 5 minutes or so. Also coupled to the timer 60 is a fire sensing circuit 61 which also energizes the alarm. As mentioned above, the alarm 12 operates at a different frequency of operation when sensing a fire than it does when sensing a burglary or a tampering attempt. This is accomplished by changing the frequency of operation of the alarm driver horn associated with the alarm 12.

To prevent resetting of the entire circuit when a power failure occurs on line 42, a relatively large capacitor 45 is connected across the distribution-output line 44 and provides sufficient stored energy to the circuit during the transition period of the movable contact 46 of the relay holding coil 47.

Selector push button switches 33 of the remote access selector panel 30 are numbered 1 to 12 from top to bottom as seen in FIG. 2*a*. However, it will be understood that they may be numbered 1 to 10 and A, B. In the circuit embodiment illustrated herein, the access number code is selected as being 1, 2, 4, 6 and 8 in that order. Thus, the circuitry is such that in order to activate the alarm system, the switches 1, 2, 4, 6 and 8 must be activated in sequence. The sequence must then be repeated when it is desired to disable the alarm system.

In accordance with a feature of the present invention, the circuit includes means for sensing and storing errors and deviations in the operation of the switches 33 either in the number of the particular switch activated or the sequence in which the switches 1, 2, 4, 6 and 8 are operated, at any time after a predetermined indicator switch is operated. Furthermore, means are provided so that, in the event of a plurality of consecutive erroneous attempts to activate the switches 33 in the preferred coded sequence are detected, an alarm, either local or remote or both, is energized. If, however, the correct sequence of numbers is entered, the system will, of course, be deactivated, and the memory of the preceding error is erased.

Should any of switches 33 be activated in any improper sequence, a signal will be registered in a memory circuit 62. In the event that a second erroneous attempt is made to actuate the switch in sequence, a second error indication or improper sequence will cause an output to be generated by the memory circuit 62 and applied to the alarm circuit 12. Preferably a timing circuit 63 is interposed between the memory circuit and the alarm circuit to delay actuation of the alarm for a period, say for example, of 15 seconds. If an authorized person has simply made careless errors in actuating the push buttons, this time delay gives him a chance to quickly enter the proper code before the alarm goes off. If the proper sequence of digits is selected after the second error and before the 15 second timing circuit is finished timing, the alarm will not be energized.

Referring to the circuit more in detail, it is seen that the first switch, switch No. 1, of the selector switches 33 is connected to a start and hold circuit 64 which may comprise a circuit arrangement such as a Schmitt trigger. The output of the Schmitt trigger 64 is applied to a flip-flop circuit 65 through a line 66. Line 66 is coupled to the trigger input terminal of the flip-flop to cause the output line 68 thereof to go high when digit No. 1 of switch 33 is actuated. The high or logic one state of flip-flop 65 is then coupled to an input of a pair of AND gates 69 and 70. AND gate 69 is utilized in determining the proper sequence of the digits being selected while AND gate 70 is utilized in indicating when an improper sequence of digits is selected.

In the embodiment being described herein, the second proper digit to be selected is the switch numbered two which applies an input signal across line 71 to the second input of AND gate 69. This will produce an output through the AND gate 69 over a line 72 to the input of a flip-flop circuit 73. Flip-flop circuit 73 has its output coupled to a line 74 which, in turn, is connected to inputs of a pair of AND gates 75 and 76. AND gate 75 is utilized in determining the further proper sequence of digits to be selected while AND gate 76 is utilized to indicate an improper sequence of digits.

The third digit to be selected is the switch numbered four and applies a pulse over a line 78 to the second input of AND gate 75. AND gate 75 has its output coupled over a line 79 to the input of a flip-flop circuit 80. Flip-flop circuit 80 has its output connected over a line 81 to the input of a pair of AND gates 83 and 84.

The fourth digit to be selected is the number six and applies a pulse along the line 85 to the second input of AND gate 83. This will produce output from the AND gate 83 over a line 86 to a flip-flop circuit 87 which, in turn, applies a logic one state to the input of AND gate 89 and to the input of an AND gate 90. AND gate 89 is used to determine the proper sequence of digits while AND gate 90 is used to indicate a wrong digit has been selected.

The fifth and final digit of the preselected code is digit 8 and applies a signal over a line 91 to the second input of AND gate 89. The output of AND gate 89 is applied over a line 92 to the input of a flip-flop circuit 93 which, in turn, applies a logic one state to a line 94. Line 94 is coupled to a latching circuit 95 which is placed in a set condition from the output line 53 when the system is turned on. Therefore, each subsequent operation of the proper sequence of numbers will alternately provide an output signal to set the flip-flop circuits associated with the memory 62, to be described in greater detail hereinbelow.

The output of the latching circuit 95 is connected to the line 59 which is coupled to one input of an AND gate 97 (FIG. 2*b*). The other input of the AND gate 97 is connected for receiving a signal from an amplifier stage 99 which is operated by the plurality of zone switches 14, 15, 16 and 17. When the circuit is armed and the output of the latching circuit is high, AND gate 97 is enabled and, therefore, responsive to opening of any of the zone switches. This will produce an output signal on line 100 coupled to the input of a flip-flop circuit 101 (FIG. 2*a*), which, in turn, is connected to the timer 60 and controls operation of the audio alarm 12 (FIG. 2*c*). Should a burglar open a window or door and thereby actuate one of the zone switches 14, 15, 16 and 17, the alarm will be energized.

The output of latching circuit 95 is also coupled to a time delay reset circuit 103 (FIG. 2*c*) which produces an output signal along line 104 connected to all of the reset inputs of flip-flop circuits 73, 80, 87 and 93. This then resets the circuit for a subsequent manipulation of the selected code without disarming the alarm circuit. When it is desired to disarm the circuit from the remote access selector panel, switches 33 are manipulated in the same predetermined code, namely 1, 2, 4, 6 and 8 in that order. This will produce an output signal from flip-flop circuit 93 in the same manner as mentioned above to apply a logic one to line 94. However, in this instance, the latching circuit 95 is placed in the logic zero state and this disables the memory 62 and removes the enabling signal from AND gate 97 to allow one or more of the zone switches 14, 15, 16 and 17 to be opened without setting off the alarm 12.

To detect an incorrect digit in the sequence of digits, four multi-input OR gate circuits 106, 107, 108 and 109 are provided (FIG. 2*a*). The OR gate circuit 106 is connected to all of the selector switches 33 except the selector switches for the digit two. The OR gate circuit 107, on the other hand, is coupled to all of the switches 33 except the switch associated with digit four. Similarly, OR gate 108 is connected to all of the switches 33 except the switch associated with the digit 6. OR gate 109 is connected to all of the switches except the switch associated with digit 8.

In operation, when the selector switches 33 of the remote access selector panel 30 are manipulated, the circuit of FIG. 2 is not affected until the first digit of the predetermined sequential code is actuated. In the illustrated embodiment, this digit is the number one. When the switch associated with the number one is actuated, the signal is applied to the start and hold circuit 64 to place a high output on line 68 by operation of the flip-flop circuit 65. As mentioned above this high or logic one output is also coupled to one of the inputs of AND gate 70. The next digit in the sequence is the digit two. Therefore, the switch identified by digit two must be actuated to apply signal to line 71 to the input of AND gate 69. Should any other switch than that identified by digit two be actuated, the signal will be applied to one of the inputs of the OR gate 106 to apply the second input to AND gate 70, which, in turn, sets a first flip-flop circuit 112 of the memory circuit 62. The flip-flop circuit 112 therefore registers that a first incorrect selection has been made. The output of AND gate 70 is also coupled to a line 113 which is connected to all of the R inputs of the flip-flops 73, 80, 87 and 93 to reset the flip-flops and, therefore, require that the predetermined sequence be restarted from the first digit of the sequence. Therefore, the switch identified by digit one must again be actuated to start the proper sequence for disabling the alarm circuit. If, during the second attempt, for example, digits 1, 2, 4 and 6 are pressed in the proper sequence and a digit other than the digit 8 is selected, OR gate 109 will produce an output signal to the input of AND gate 90 which is enabled by the output of flip-flop circuit 87 resulting from the selection of the first four proper digits. The output of AND gate 90 produces a reset signal to again reset the flip-flops 73, 80, 87 and 93. In addition, a second input to the memory circuit 62 will cause flip-flop circuit 112 to actuate flip-flop circuit 114 which, in turn, produces an output signal along the line 115 to the input of the fifteen second timing switch 63. Now the operator of the selector switches 33 must again restart selection of the predetermined code from the first digit of the code and he must enter the proper code within 15 seconds to prevent sounding the alarm. After the 15 second time interval, an output signal from the timer 63 is supplied to flip-flop circuit 101 over a line 116 to produce an output to the timer 60 which, in turn, energizes the audio alarm system 12 in accordance with the timed frequency signal selected for indicating that tampering with the remote access selector has been detected.

A status input selector control is provided to enable the user to manipulate predetermined switches on the remote access selector 30 to gain information as to the status of the alarm system. For example, the user may determine whether the alarm is already enabled or disabled or if there are any shunt circuits which are bypassing zone protecting switches. To gain status information, two additional switches 33 are used and in the embodiment shown, the switches associated with numbers 9 and 11 are utilized. The arrangement is such that the digit 11 is actuated first to apply a signal over a line 118 to the input of a flip-flop circuit 119. The flip-flop circuit 119 will then provide a high or logic one signal to one of the inputs of AND gate 120 (FIG. 2*b*). A second digit, here preferably the digit 9, is then actuated to apply a signal over line 121 to the second input of AND gate 120. This provides an output to a five second timing switching circuit 123 to place an enabling signal to one of the inputs of AND gates 124, 125, 126 and 127.

If there is an open circuit in one of the protected zones monitored by switches 14, 15, 16 or 17, AND gate 124 will then have a second input applied thereto through an inverter or other suitable circuit 128. This will cause the AND gate 124 to apply operating voltage and current to a light-emitting diode 37 which then provides a visual indication that a protected zone is open. When the circuit is armed or on, flip-flop circuit 132 is set by the signal from the line 53 applied to the set input terminal 133 thereof. This will cause a logic one state to appear on line 134 and pass through OR gate 135 to AND gate 125. AND gate 125 will therefore energize a light-emitting diode 34 during the 5 second interval provided by the timing switching circuit 123 when the system is on. However, when the system is off or disabled, the signal from flip-flop circuit 132 will pass through OR gate 139 to AND gate 126 and energize light-emitting diode 36.

The zone protector switches 14, 15, 16 and 17 are adapted to be shunted or bypassed by shunt switches 142, 143, 144 and 145 respectively. Therefore, if it is desired to have one of the zones open or in an unprotected condition, its associated zone switch may be easily bypassed. However, should the user of the system forget to deactivate the shunt switch, the zone switch will not indicate that a burglary attempt has been made. Therefore, a shunt indicator circuit is also provided. The shunt switches 142, 143, 144 and 145 are connected to an OR gate 148 through a plurality of lines designated generally by reference numeral 149. The output of OR gate 148 is connected to AND gate 127 which is enabled by the five second timing circuit 123 to energize a light-emitting diode 38. Therefore, when the status selector switches are actuated in proper sequence, the circuit will provide a 5 second indication as to the condition of the system, whether it is disabled, inabled, has open circuit zone switches, or has one or more of the shunt switches actuated.

Another feature of the present invention is the incorporation of a silent panic alarm which enables the user of the system to provide an indication to a remote location, such as a police station, should he be required to disable the alarm under duress. For example, the user may be forced to manipulate the proper sequence of digits to disable the alarm. However, it is contemplated that a sixth digit, here represented by the number 12, or any suitable letter of the alphabet, is actuated to provide an output signal over a line 152. This signal will be applied to one input of an AND gate 153 which has the other input thereof coupled to the output of an inverter circuit 154 which receives output signals from the latching circuit 95. When the latching circuit 95 is in the high or logic one state, the input to AND gate 153 is low or zero. Therefore, upon the proper manipulation of the first five digits in sequence, the latch 95 is set to the low state and disables the system. At the same time, inverter 154 places a high or logic one state on AND gate 153 and therefore actuation of the sixth predetermined digit will produce a signal to an encoded circuit arrangement designated generally by reference numeral 155. The encoded circuit 155 may be any suitable device, here preferably being a circuit which produces a series of pulses or signals corresponding to the subscriber's or user's telephone number. The coded telephone number is then sent over the telephone line 13 to the police station and identifies the subscriber who is in need of assistance.

The logic circuit diagram illustrated in FIGS. 2*a*, 2*b* and 2*c* can easily be constructed from conventional integrated circuit components commercially available. The components used in the circuit can be those identified by standard Part Nos. 9N04/7404, 9N08/7408, 9396/7496, 9N20/7420, 9N02/7402, 9N73/7473, 9N38/7438, 9N00/7400, 9N27/7427, and available from several manufacturers. While these specific integrated circuits have been used, it will be understood that other suitable circuits can be utilized to achieve the necessary logic functions to operate a security alarm system in accordance with the principles of this invention.

While a single specific embodiment of the present invention has been shown and described herein, it will be understood that variations and modifications may be effected without departing from the novel concepts as set forth in the following claims.

The invention is claimed as follows:

1. Activation means for a security system having an alarm circuit for allowing an authorized person selectively to enable and disable the alarm circuit, said activation means comprising; a plurality of individually and sequentially operable signalling means, circuit means connected with said signalling means and responsive to a plurality of signals in a predetermined sequence from said signalling means for enabling said alarm circuit when the alarm circuit is disabled and for disabling said alarm circuit when the alarm circuit is enabled, and additional circuit means coupled with said signalling means for successively sensing, upon actuation of said signalling means, the signals of a first group of successive signals from said signalling means and comparing said successively sensed signals with a predetermined sequence and for storing an error when at least one of said successively sensed signals deviates from said predetermined sequence, and said additional circuit means including means for sensing an error in the sequence of a second group of successive signals transmitted from said signalling means after said first group and for providing an alarm signal to said alarm circuit only after sensing said error in said second group.

2. Activation means for a control system for allowing an authorized person selectively to enable and disable the system as set forth in claim 1 further including; reset means responsive to sensing said error in said first group of successive signals for resetting said additional circuit means for receiving a second group of signals, and said additional circuit means including memory circuit means for receiving said first error signal, said memory circuit means disabling said alarm signal until said error signal in said second group is detected.

3. Activation means for a control system for allowing an authorized person selectively to enable and disable the system as set forth in claim 1 further including; time delay means for receiving said alarm signal and producing an alarm indication only after a predetermined time interval after sensing said error in said second group.

4. Activation means for a control system for allowing an authorized person selectively to enable and disable the system as set forth in claim 1 further including; status condition indication means, said status condition indication means including said plurality of individually and sequentially operated signalling means and circuit means connected with said last mentioned signalling means, said indication means and said alarm circuit and responsive to said last mentioned signalling means and to the condition of said alarm circuit means for energizing said indication means and producing a readout as to the condition of said alarm circuit means.

5. Activation means for a control system for allowing an authorized person selectively to enable and disable the system as set forth in claim 1 wherein, said plurality of individually and sequentially operated signalling means is located at a location remote from that of said alarm circuit means.

6. In a security alarm system, the combination comprising: an alarm circuit, selector means for selecting a predetermined coded number for enabling and disabling said alarm circuit, starting circuit means responsive to said selector means only when a preset first digit of said predetermined coded number is selected for starting an access sequence to said alarm circuit, coded circuit means responsive only to said predetermined coded number for producing a control signal when said predetermined coded number is registered into said selector means, means coupling said control signal to said alarm circuit to enable said alarm circuit when disabled and to disable said alarm circuit when enabled, error detection means coupled with said starting circuit means and responsive only to the selection of said first digit to be placed in readiness for detecting subsequent incorrect digits when attempting to select said predetermined coded number, and alarm trigger means coupled to said error detection means and to said alarm circuit to energize said alarm circuit when an incorrect digit of said predetermined coded number is detected in a preselected plurality of successive attempts to select the coded number.

7. A security alarm system as set forth in claim 6 wherein said alarm trigger means is responsive to a second error in the selection of said predetermined coded number.

8. A security alarm system as set forth in claim 6 further including reset means responsive to the error detection means for resetting said coded circuit means upon detecting a first incorrect selection, and memory means for receiving said first incorrect selection and producing an output signal in response to a second incorrect selection, said output signal coupled to said alarm trigger means for energizing said alarm circuit.

9. A security alarm system as set forth in claim 8 further including time delay means coupled between said memory means and said alarm trigger means to energize said alarm circuit after a predetermined time interval following the detection of said second error signal.

10. A security system as set forth in claim 6 further including panic alarm circuit means coupled to said selector means for enabling an additional digit to be selected following said predetermined coded number to produce a panic alarm signal.

11. A security alarm system as set forth in claim 6 further including status indicating circuit means, said status indicating circuit means being operated in response to the actuation of said selector means when a second predetermined coded number is selected to provide an indication whether the security alarm system is actuated or disabled.

12. A security alarm system as set forth in claim 6 further including panic alarm circuit means coupled to said selector means for enabling an additional digit to be selected following said predetermined coded number to produce a panic alarm signal, and further including status indicating circuit means, said status indicating circuit means being operated in response to the actuation of said selector means when a second predetermined coded number is selected to provide an indication of whether the security alarm system is actuated or disabled.

13. In a security alarm system having an alarm circuit, the combination comprising a plurality of individually and sequentially operating signalling means, circuit means connected with said signalling means and responsive to a plurality of signals in a predetermined sequence for enabling said alarm circuit when the alarm circuit is disabled and for disabling the alarm circuit when the alarm circuit is enabled, and additional circuit means coupled with said signalling means for successively sensing signals from said signalling means and responding to a signal deviating from said predetermined sequence and providing an alarm signal to said alarm circuit.

* * * * *